US005197496A

United States Patent [19]

Nakamura

[11] Patent Number: 5,197,496

[45] Date of Patent: Mar. 30, 1993

[54] METHOD FOR PRODUCING A MAKEUP APPLICATOR

[75] Inventor: Kenji Nakamura, Osaka, Japan

[73] Assignee: Kennak U.S.A., Inc., New York, N.Y.

[21] Appl. No.: 670,976

[22] Filed: Mar. 18, 1991

Related U.S. Application Data

[63] Continuation-in-part of Ser. No. 521,153, May 9, 1990.

[30] Foreign Application Priority Data

Mar. 16, 1990 [JP] Japan ..... 2-66033

[51] Int. Cl.[5] ..... A45D 24/00

[52] U.S. Cl. ..... 132/200; 132/218; 132/320; 300/21

[58] Field of Search ..... 132/216, 218, 317, 200, 132/320; 264/544; 300/21, 4

[56] References Cited

U.S. PATENT DOCUMENTS

| | | | |
|---|---|---|---|
| 4,602,650 | 7/1986 | Pipkin | 132/320 |
| 4,884,849 | 12/1989 | Shaw | 300/4 |
| 4,998,315 | 3/1991 | Pessis | 132/320 |

FOREIGN PATENT DOCUMENTS

| | | | |
|---|---|---|---|
| 3539478 | 5/1987 | Fed. Rep. of Germany | 132/320 |
| 3641391 | 2/1988 | Fed. Rep. of Germany | 132/320 |
| 1-72813 | 5/1989 | Japan . | |
| 1-119203 | 5/1989 | Japan . | |

*Primary Examiner*—Gene Mancene
*Assistant Examiner*—Frank A. LaViola
*Attorney, Agent, or Firm*—Brooks Haidt Haffner & Delahunty

[57] ABSTRACT

An applicator for makeup use, wherein an applying portion and at least a front portion of a handle portion are made of a bundle of fibers. The bundle of fibers includes a sheath portion and a core portion. The core portion is made of a bundle of fibers including a plurality of straight fibers. The sheath portion is made of thermoplastic fibers, which have crimps therein and partially adhere to each other, and wraps about the core portion. The applying portion of the applicator is made of the straight fibers of the core portion. The handle portion is made of the fibers of the core portion, the fibers of the sheath portion and a sheet-like material. The fibers of the sheath portion are thermoformed at the handle portion located near a base portion of the applying portion. The sheet-like material wraps about an outer periphery of the handle portion which periphery is not thermoformed.

4 Claims, 8 Drawing Sheets

FIG. 1(a)
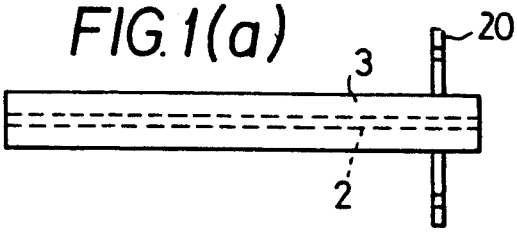
FIG. 1(b)
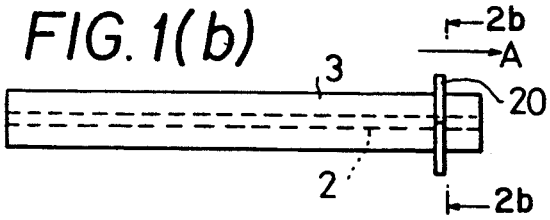
FIG. 1(c)
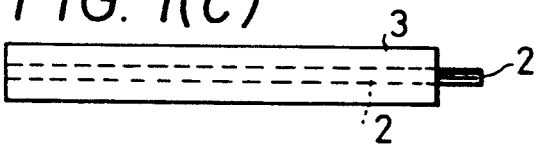
FIG. 1(d)
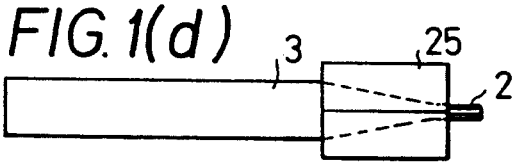
FIG. 1(e)
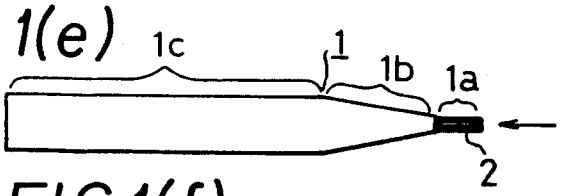
FIG. 1(f)
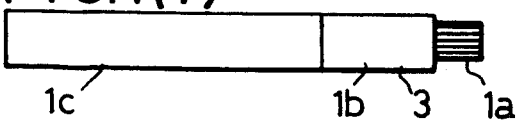
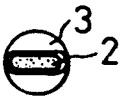
FIG. 1(g)
FIG. 2(a)
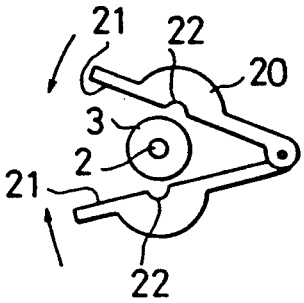
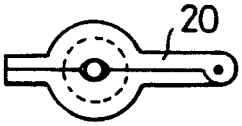
FIG. 2(b)
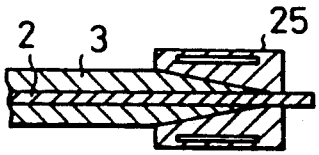
FIG. 3

FIG. 9(a)
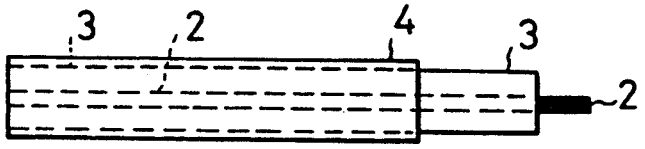
FIG. 9(b)
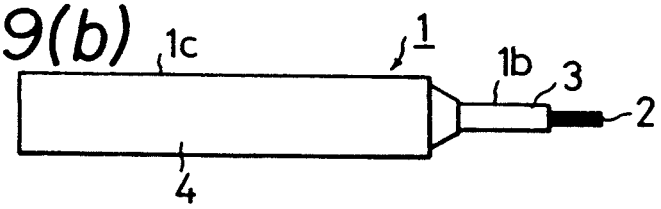
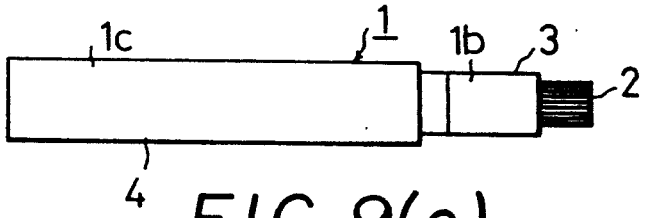
FIG. 9(c)
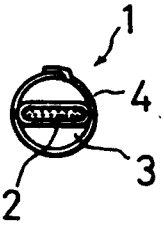
FIG. 9(d)
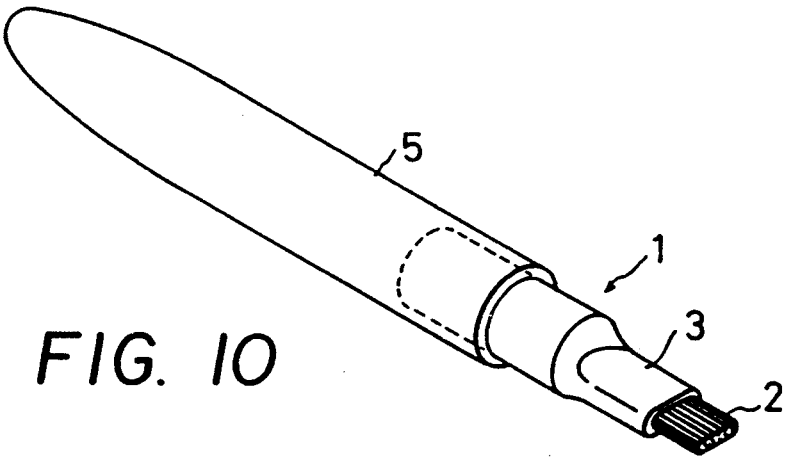
FIG. 10

METHOD FOR PRODUCING A MAKEUP APPLICATOR

CROSS REFERENCE TO RELATED APPLICATION

This application is a continuation-in-part application of U.S. Ser. No. 521,153, filed on May 9, 1990, pending.

FIELD OF THE INVENTION

The present invention relates to an applicator for makeup use, a method for producing the same, and an apparatus for effecting the same.

BACKGROUND OF THE INVENTION

More specifically, the present invention relates to an applicator for makeup use, which is suitable for applying a cosmetic to a customer when an instructor teaches how to apply the cosmetic to the customer's face at a cosmetic store, which has a high applying capability and which is inexpensive since it is of a disposable type.

The present invention also relates to a method for producing such a suitable applicator, and an apparatus for effecting the method.

Makeup cosmetics include various kind of cosmetics, such as lipstick, rouge, and eye shadow. As an applicator of such cosmetics, a brush made of horse bristles or goat bristles and an applicator made of foam, such as rubber foam or polyurethane have been used.

In the meantime, there is a tendency to actually try to apply makeup cosmetic at a cosmetic store when makeup cosmetics are sold. In this case, an applicator for makeup cosmetic is used.

In view of the area to which makeup is applied, i.e., eyes, lips and so on, it is undesirable from the sanitary point of view to use the single same applicator for an unspecified number of persons on trial applications of makeup cosmetics.

Accordingly, when the persons, to whom cosmetics are applied, are different, the applicator is wiped with tissue paper or is cleaned and dried after application to one person. Therefore, it is troublesome.

A conventional applicator formed in a stick or a brush includes an applying portion made of straight fibers or bristles. The base portion of the fibers or bristles, which serve as the applying portion, is tightly fastened by a metal band. Then, the applying portion is attached to a handle made of a synthetic resin or a metal. As described above, manufacture of such a conventional applicator is troublesome, and accordingly, the applicator is expensive. Consequently, the conventional applicator can not be disposed of once it is used. Especially, an applicator is expensive when it has an applying portion made of horse bristle or goat bristle, and therefore, it is uneconomic to dispose of such an expensive applicator after every use.

When foam is used as an applying portion of an applicator, the applicator is manufactured by connecting the applying portion to a handle by an adhesive, after the surface of a core member made of thin synthetic resin sheet is covered by a foam to form the applying portion. In another applicator wherein foam is used as an applying portion, the applicator is manufactured by covering a core portion made of a synthetic resin with foam, after a thin portion, which will be the core portion, and a thick portion, which will be a handle, are molded in one body.

In both the manufacturing methods described above, it is necessary to cover the core portion by foam formed in a predetermined shape in each applicator. Accordingly, operations are required wherein individual member of synthetic resin, which will be a core portion, is set at a predetermined position, thereafter it is covered by foam, and the foam surrounding the core portion is punched. Thus, the operation is very troublesome, and the manufacturing cost is expensive. Accordingly, the thus manufactured applicator is uneconomic as an applicator of a disposable type.

In order to obviate the above-described problems, the present inventor proposed in Japanese Patent Application Laid-open No. Hei 1-119203 and Japanese Utility Model Application Laid-open No. Hei 1-72813 an applicator for makeup use made of a bundle of acetate fibers, wherein only an applying portion comprises straight fibers and the remaining portions comprise crimped fibers. Further, the inventor proposed a method for manufacturing the applicator which comprises: a first step wherein after crimped acetate fibers are gathered and formed in a rod, the rod is cut in a predetermined length; a second step wherein an end of the rod formed in the first step is sharpened by grinding to form an applying portion; a third step wherein only the applying portion is supplied with or impregnated with treating liquid including water so that the crimped fibers are straightened into straight fibers; and a fourth step wherein the applying portion obtained in the third step is dried.

According to the applicator for cosmetic use and the method for manufacturing the same, which the present inventor previously proposed, the applying portion is sharpened by abrading and grinding one end of the bundle of fibers. However, the operational efficiency for abrading or grinding operation of the bundle of crimped fibers in a pointed end is low, and accordingly, the productivity is low. Further, the portion which is abraded or ground may be easily fluffed, and accordingly, the quality of the obtained applicator may be deteriorated.

In addition, since the portion near the base of the applying portion is abraded or ground, the support of the applying portion becomes weak, and the applicator is not stiff. As a result, when a makeup cosmetic, such as lipstick, is applied with the proposed applicator, the applicator may bend at the base of the applying portion, and accordingly, the cosmetic cannot be applied well to the desired portion, i.e., the lip. More specifically, it is difficult for a user of the applicator to draw a line at will or to apply the cosmetic to the desired portion.

Furthermore, since a lip brush is used both to draw the outlines of the lip and to apply lipstick to the entire surface of the lip, it is preferred for the front end of the lip brush to be flat. However, it is difficult to obtain an applicator with a flat end in accordance with the previous proposal.

Besides, according to the previous proposal, the portion in the bundle of the fibers, which will be the applying portion, is treated with treating liquid so that the crimped fibers become straightened to obtain straight fibers, however, the crimps often remain in the fibers. If the crimps remain, makeup cosmetics may enter into the applying portion of the applicator, i.e., clearances formed by the crimps between the fibers, and the cosmetics will not come out easily. Accordingly, the cosmetics cannot be applied well to the skin.

The present invention has been achieved taking into consideration the above-described background, and an object of the present invention is to provide an applicator for makeup which is inexpensive and easy to use, and by which makeup cosmetics can be suitably applied at will.

Another object of the present invention is to provide a method which can manufacture the above-described applicator for makeup use of the present invention provided with a sufficient applying capability at low cost and at high productivity.

A still further object of the present invention is to provide an apparatus which is suitable for performing the above-described method of the present invention.

SUMMARY OF THE INVENTION

According to the present invention, the above-described object is achieved by an applicator for makeup use, wherein an applying portion and at least a front portion, i.e., an end close to the applying portion, of a handle portion are made of a bundle of fibers, comprising:

the bundle of fibers comprises a sheath portion and a core portion, the core portion being made of a bundle of fibers comprising a plurality of straight fibers, and the sheath portion being made of thermoplastic fibers, which have crimps therein and partially adhere to each other, and wrapped about the core portion;

the applying portion of the applicator is made of the straight fibers of the core portion;

the handle portion is made of the fibers of the core portion and the fibers of the sheath portion; and the fibers of the sheath portion are thermoformed at one end of the handle portion located near the base of the applying portion.

Further, according to the present invention, the above-described object is achieved by a method for producing an applicator for makeup use comprising:

preparing an elongated bundle of fibers of a predetermined length having a core portion consisting of a plurality of straight fibers and a sheath portion wrapped around said core portion consisting of crimped thermoplastic fibers adhering partially to each other;

removing a longitudinal section of the fibers of the sheath portion at one end of the bundle from about the fibers of the core portion to expose an end portion of the fibers of the core portion;

and applying heat and pressure to the thermoplastic fibers over a region adjacent the exposed end portion of the core portion to heat-soften, radially compact, and bond together the thermoplastic fibers in said region about the core fibers.

Furthermore, according to the present invention, the above-described object is achieved by an apparatus for producing an applicator for makeup use, which comprises:

a means for feeding a rod-like bundle of fibers of a predetermined length which comprises a core portion made of a plurality of straight fibers and a sheath portion made of thermoplastic fibers, which have crimps therein and partially adhere to each other;

a cutting means for imparting a circumferential cut to the fibers of the sheath portion at an end of the bundle of fibers at a depth sufficient to reach the fibers of the core portion;

a means for removing the fibers of the sheath portion located at the end beyond the cut; and a means for thermoforming the thermoplastic fibers of the sheath portion around the cut.

The cost of raw material of the applicator for makeup use of the present invention is very inexpensive, since the applicator comprises a bundle of fibers, and crimped fibers are used as the fibers of the sheath portion.

Further, there is avoided the problem inherent to the previously proposed applicator that the makeup cosmetics enter into clearances between the crimped fibers since originally straight fibers are used for the applying portion.

In the applicator for makeup use of the present invention, the fibers of the sheath portion, which comprises crimped fibers and which surrounds straight fibers of the core portion, are thermoformed at the base of the applying portion while they are not ground or abraded and while their amount is maintained. Accordingly, the thermoformed fibers of the sheath portion can securely hold the fibers of the applying portion, i.e., the fibers of the core portion. As described above, since the applying portion is securely held and since accordingly the base of the applying portion is not bent easily, lines can be drawn at will with makeup cosmetics and the desired amount of makeup cosmetics can be applied to the desired portion.

In addition, the applicator for makeup use of the present invention can have a suitable shape for a lip brush since the straight fibers of the applying portion can be arranged flat by thermoforming the base of the applying portion of the applicator of the present invention in a flat shape.

Besides, the applicator for makeup use of the present invention is not fluffed unlike that obtained by abrading or grinding since the base of the applying portion is thermoformed.

According to the manufacturing method of the present invention, fibers of the sheath portion are removed at one end of an elongate bundle of fibers of a predetermined length while the fibers of the core portion remain so that the fibers of the core portion are exposed, and the fibers of the sheath portion around the base portion of the exposed fibers of the core portion are thermoformed. Since abrading or grinding operation is unnecessary in the method of the present invention, manufacture of the applicator for makeup use of the present invention does not take time, and the time required for a single applicator is short. Accordingly, according to the method of the present invention, the applicators can be manufactured at high productivity.

The apparatus for producing an applicator for makeup use of the present invention comprises:

a means for feeding a rod-like bundle of fibers of a predetermined length which comprises a core portion made of a plurality of straight fibers and a sheath portion made of thermoplastic fibers, which have crimps therein and partially adhere to each other;

a cutting means for imparting a circumferential cut to the fibers of the sheath portion at one end of the bundle of fibers at a depth sufficient to reach the fibers of the core portion;

a means for removing the fibers of the sheath portion located at the end beyond the cut; and a means for thermoforming the thermoplastic fibers of the sheath portion adjacent the cut, and the applicators for makeup use of the present invention can be manufactured one after another.

BRIEF DESCRIPTION OF THE DRAWINGS

The present invention will now be explained in detail with reference to the accompanying drawings which show some embodiments of the present invention, wherein:

FIGS. 1(*a*) to 1(*d*) are front views showing process for manufacturing applicator for makeup use of the present invention;

FIG. 1(*e*) is a front view of the obtained applicator for makeup use of the present invention;

FIG. 1(*f*) is a plan view of FIG. 1(*e*);

FIG. 1(*g*) is an end view seen along the arrow in FIG. 1(*e*);

FIGS. 2(*a*) and 2(*b*) are side views showing operational conditions of an embodiment of a cutting device of a manufacturing apparatus of the present invention wherein:

FIG. 2(*a*) corresponds to FIG. 1(*a*); and

FIG. 2(*b*) is a cross sectional view along line 2*b*–2*b* in FIG. 1(*b*);

FIG. 3 is a cross sectional view showing an embodiment of a thermoforming device of the manufacturing apparatus of the present invention;

FIGS. 9(*a*) to 9(*d*) show another embodiment of the applicator of the present invention, wherein:

FIG. 9(*a*) is a front view of the applicator before it is thermoformed;

FIG. 9(*b*) is a front view of the applicator after it is thermoformed;

FIG. 9(*c*) is a plan view of FIG. 9(*b*); and

FIG. 9(*d*) is a right end view of FIG. 9(*b*);

FIG. 10 is a perspective view of another embodiment of the applicator for makeup use of the present invention;

FIGS. 18 to 20 are side views in the direction of the arrow A in FIG. 11 and showing the operational conditions of a device for removing fibers of the sheath portion and the sheet-like material at an end beyond a cut, wherein:

FIG. 18 is a side view at position 18 in FIG. 11;

FIG. 19 is a side view at position 19 in FIG. 11; and

FIG. 20 is a side view at position 20 in FIG. 11;

FIGS. 21 and 22 are views showing the operational conditions of a device for thermoforming fibers of the sheath portion around the cut and a device for transferring a rod-like material, wherein:

FIG. 21 is an end elevation in the direction of the arrow A at position 21 in FIG. 11;

FIG. 22 is an end elevation at position 22 in FIG. 11; and

DETAILED DESCRIPTION OF THE INVENTION

Figure 4:
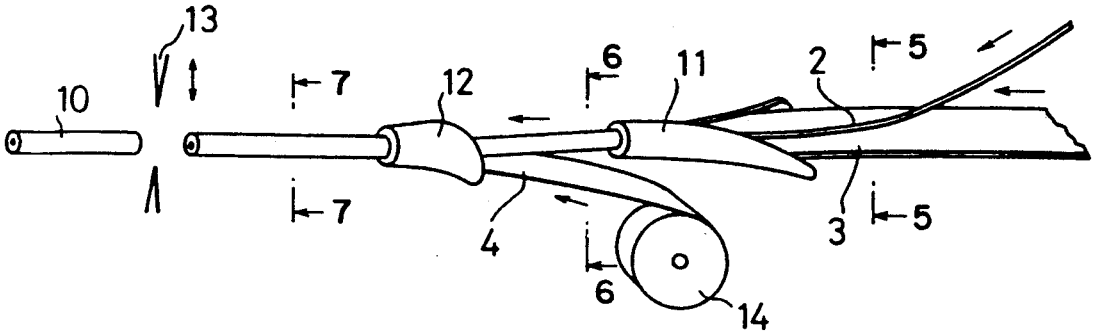
FIG. 4 is a perspective view explaining a step for manufacturing rod-like material which is a raw material of the applicator for makeup use of the present invention.

Reference should now be had to FIGS. 1 to 3.

An applicator 1 for makeup use of the embodiment illustrated in FIG. 1 comprises a bundle of fibers, which comprises a core portion 2 and a sheath portion 3 surrounding the core portion.

The core portion 2 comprises a plurality of straight fibers 2, and the sheath portion 3 comprises a plurality of thermoplastic fibers having crimps, and the fibers of the sheath portion 3 partially adhere to each other.

As illustrated in FIGS. 1(*e*) to 1(*g*), the applying portion 1*a* of the applicator 1 for makeup use comprises the straight fibers of the core portion 2, and a handle portion designated by reference numerals 1*b* and 1*c* of the applicator 1 for makeup use comprises the fibers of the core portion 2 and the sheath portion 3.

Since all the fibers of the applying portion 1*a* are the straight fibers as described above, makeup cosmetics do not enter clearance formed between crimped fibers. Further, since the handle portion 1*c* comprises straight fibers of the core portion 2 and the fibers of the sheath portion 3, which have crimps and partially adhere to each other, the handle portion has a suitable stiffness and elasticity and is easily held as the applicator 1 for makeup use.

According to the present invention, in the handle portion 1*b* around the base of the applying portion 1*a*, the fibers of the sheath portion 3 are thermoformed so that the clearance between the crimped fibers becomes small, and accordingly, the hardness of the handle portion 1*b* is enhanced relative to that before the thermoforming operation. In this case, in the handle portion 1*b*, which is adjacent to the applying portion 1*a*, it is preferred that the portion near the applying portion 1*a* is thermoformed more than the portion away from the applying portion 1*a*.

For example, in the embodiment illustrated in FIGS. 1 to 1(*g*), the handle portion 1*b* is pressed in a vertical direction and is tapered toward the applying portion 1*a* when it is seen from the front, while it has a width which is almost the same as that before it is thermoformed. Thus, the front end of the handle portion 1b, i.e., the end close to the applying portion 1a, is flat, and the fibers of the core portion 2 are also formed in a flat condition. The applying portion 1a of the applicator 1 for makeup use having a flat shape is suitable for a lip brush.

The shape of the handle portion 1b around the base of the applying portion 1a is not limited, and it may be a conical shape or may be uniformly pressed in a flat shape as it will be explained later with reference to FIG. 9.

The materials suitable for the fibers of the core portion 2 of the applicator for makeup use of the present invention are rayon, nylon, acrylic or polyester. Since the fibers of the sheath portion 3 of the handle portion 1b which is located around the base of the applying portion 1a is thermoformed, material which does not softened or melt at the thermoforming temperature of the handle portion 1b is preferable for the fibers of the core portion 2. Especially, rayon is suitable for the fibers of the core portion 2.

The thickness of individual fibers of the core portion 2 is preferably between 20 and 100 denier. For example, it is selected between 40 and 70 denier if the applicator is a lip brush.

The total denier of the fibers of core portion 2 is appropriately selected depending on the usage of the applicator, such as a blush brush, a lip brush, or a brush for eye shadow. For example, the total denier is selected between 15,000 and 25,000 denier for a blush brush or a lip brush.

Thermoplastic fibers, especially acetate fibers or acrylic fibers are suitable, for the materials of the fibers of the sheath portion 3 of the applicator for makeup use of the present invention. Alternatively, conjugate fibers which are composed of fibers having a relatively low melting point and fibers having a relatively high melting point, may be used for the fibers of the sheath portion 3 of the applicator for makeup use. The conjugate fibers are, for example, sheath and core fibers, the core of which is made of polyester, polypropylene or the like and the sheath of which is made of polyethylene of a low melting point or the like. Further, the fibers of the sheath portion 3 may be any thermoplastic fibers which are provided with a hot melt adhesive of a powder type applied thereto. The powder type hot melt adhesive can be sprinkled over the fibers 3 to be the sheath portion in the process for manufacturing the applicator for makeup use before the fibers 3 of the sheath portion surround the fibers 2 of the core portion.

Thickness of individual fibers 3 of the sheath portion is preferably between 2 and 10 denier. The total denier of the fibers 3 of the sheath portion is preferably selected taking the total denier of the fibers 2 of the core portion into consideration so that the fibers 3 of the sheath portion surely surround the fibers 2 of the core portion. In this case, it is preferred that a layer, i.e., the sheath portion, more than 1 mm thick is formed around the fibers 2 of the core portion before they are thermoformed.

The conditions in crimps of the fibers 3 of the sheath portion are not limited, however, the number of crimps is selected to be more than 1 per 1 cm. It is preferred to use fibers 3 having uniform crimps between 2 and 12 per 1 cm.

The reason why crimped fibers are used for the sheath portion is that the amount of used fibers can be economized, and that accordingly, the price of the manufactured applicator can be reduced. For example, when crimped fibers, individual denier of which is 2 denier and which have crimps of between 3 and 10 per 1 cm, are used to obtain a bundle of fibers, the diameter of which bundle is 6.5 cm, the number of the required fibers is about 40,000. Contrary to this, if it is tried to obtain a bundle having the same diameter by using only straight fibers, 130,000 fibers are necessary.

The crimped fibers of sheath portion are partially adhered to each other. This adhesion is done by partially applying solvent or plasticizer to the fibers so that the fibers are partially dissolved and are adhered to each other at points thereon. The partial adhesion of the fibers on their points preserves the shape of the gathered fiber bundle in a rod and adds a suitable hardness to the rod.

The following agents can be used as the solvent or the plasticizer which partially adhere the fibers.

In case of acetate fibers: butyrolactone; ethylene glycol monophenyl ether; triacetin; polyethylene glycol diacetate; dipropionate; dibutylate; dimethoxyethyl phthalate; triethyl citrate; 1,3-butylene glycol diacetate; and so on.

In case of acrylic fibers: dimethylformamide; cyclohexane; dimethyl sulfoxide; and so on.

The methods for applying the solvent or the plasticizer to the fibers may be conventionally known suitable methods, such as a method using a spray gun or a roller coating method, and the solvent or the plasticizer are applied to the fibers from the upper and lower sides thereof.

If the amount of the solvent or the plasticizer is excessively large, cellulose acetate may be dissolved and becomes in a dope-like condition. Accordingly, it is preferred that the solvent or the plasticizer is uniformly applied to the fibers.

Contrary to this, if the amount of the solvent or the plasticizer is too small, the adhered fibers may be torn easily, and accordingly, the usability of the obtained applicator is poor since the handle supporting portion may be split upon application of makeup cosmetics.

In view of the background described above, it is suitable that the amount of the solvent or the plasticizer relative to that of the acetate fibers is between 2 and 20% by weight.

In the foregoing descriptions, the crimped fibers 3 of the sheath portion are partially adhered to each other by partially applying solvent or plasticizer to the fibers so that the fibers are partially dissolved and are adhered to each other, however, in another method, the partial adhesion can be done by heating. More specifically, in case of conjugate fibers, fibers with a low melting point are partially melted by heating so that fibers 3 of the sheath portion are partially adhered to each other. Alternatively, when a hot melt adhesive of a powder type is sprinkled over thermoplastic fibers 3, the hot melt adhesive is melted by heating so that crimped fibers 3 of the sheath portion are partially adhered to each other. The applicators for makeup use which are manufactured without using solvent or plasticizer as described above are suitable for applying cosmetic containing solvent, such as manicure.

Reference should now be had to FIG. 9.

The applicator for makeup use of this embodiment is the same as that of the first embodiment described above except for the following points.

The applicator 1 for makeup use of this embodiment includes a sheet-like material 4 made of paper or synthetic resin film wrapping around the outer periphery of the handle portion 1c. Further, the handle portion 1b located near the base of the applying portion 1a is uniformly pressed and almost the entire handle portion 1b is flat.

As it will be described later, the sheet-like material 4 is used to form a rod-like bundle of fibers comprising sheath and core portions.

Although in the first embodiment, the sheet-like material 4 is omitted, it is preferred that the sheet-like material 4 is provided in the applicator for makeup use as a part of the handle portion so as to wrap the outer periphery of the rod-like bundle of fibers. More specifically, wrapping of the rod-like bundle of fibers by the sheet-like material 4 enhances the hardness of the handle portion 1c of the applicator 1 for makeup use, and accordingly, bending or torsion of the handle portion upon application of makeup cosmetics can be prevented. Therefore, the usability of the applicator 1 for makeup use is increased. Further, when the sheet-like material 4 is colored, the applicator 1 for makeup use gives an impression of high-grade articles. In addition, although naked crimped fibers 3 of the sheath portion may easily adsorb dirt, the sheet-like material 4 does not adsorb dirt relative to the fibers 3 of the sheath portion.

In the embodiment illustrated in FIGS. 9(*a*) to 9(*d*), the sheet-like material 4 covers a part of the handle portion 1c. When a thermally shrinkable film is used as the sheet-like material 4, the handle portion 1b near the base of the applying portion 1a may also be covered by the film, and the film may be thermally shrunk together with the fibers 3 of the sheath portion when the fibers 3 are thermoformed.

FIG. 10 is a perspective view of another embodiment of the applicator for makeup use of the present invention. This embodiment is different from the applicator for makeup use of the first embodiment in that the length of the handle portion of the applicator for makeup use of the present invention, i.e., the handle portions 1b and 1c comprising the fibers 2 and 3 of the core and sheath portions, is made short and that the applicator for makeup use of the present invention is detachably inserted into a cylindrical member 5 made of a paper cylinder or a synthetic resin pipe and prepared in addition to the handle portion. In this embodiment, the applicator for makeup use of the present invention is disposed of after use and the cylinder member 5 can be used repeatedly. Accordingly, this embodiment is economic. In addition, the applicator for makeup use of this embodiment gives an impression of high-grade articles due to the cylinder member 5.

Figure 24:
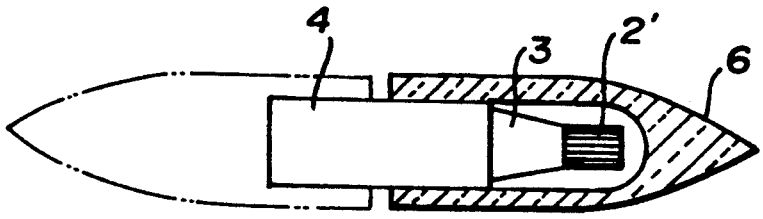
FIG. 24 is a partially cross sectioned front view of still another embodiment of an applicator for makeup use according to the present invention.

FIG. 24 is a partially cross sectioned front view of still another embodiment of an applicator for makeup use according to the present invention. In this embodiment, unlike the foregoing embodiments, the fibers 2' of said core portion which constitute the applying portion have cosmetic, such as rouge or eye shadow, attached thereto. In order to protect the applying portion which has cosmetic attached thereto, a cap 6 is covered over the applying portion. When the applicator is used, the cap 6 is removed from the front portion of the applicator, and it may be placed at the handle portion of the applicator opposite to the applying portion. Thus, the cap 6 becomes a part of the handle portion and facilitates easy use of the applicator. Further, the cap 6 performs a role similar to that of the cylinder member 5 illustrated in FIG. 10.

Figure 25:
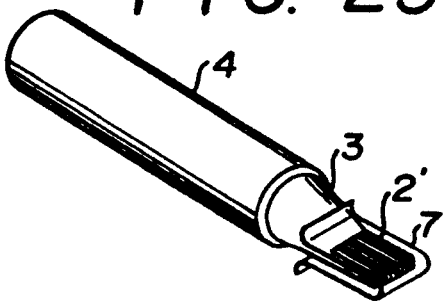
FIG. 25 is a perspective view of a further embodiment of an applicator for makeup use according to the present invention.

FIG. 25 is a perspective view of a further embodiment of an applicator for makeup use according to the present invention. In this embodiment, similar to that illustrated in FIG. 24, cosmetic is adhered to the fibers 2' of the core portion which serve as the applying portion. In place of the cap 6 illustrated in FIG. 24, a thin transparent film, made of plastic resin, such as polyvinyl chloride, polypropylene, or polyethylene, and folded in two, is used to protect both sides of the applying portion as illustrated in FIG. 25. Since the protection sheet 7 sticks to the cosmetic attached to the applying portion, it is not removed easily.

In order to attach cosmetic to the fibers of the core portion forming the applying portion, after the applicator for makeup use such as described above with reference to the foregoing embodiments has been produced, the ends of the fibers at the core portion may be rubbed with cosmetic so as to attach the cosmetic thereto or the ends of the fibers at the core portion may be dipped in cosmetic which is in solution or in a liquid condition.

The embodiments of the applicator for makeup use illustrated in FIGS. 24 and 25 are suitable for providing a customer or consumer with cosmetic for trial use. More specifically, since the applicator for makeup use itself is provided with cosmetic for trial use, it is easy for the customer or consumer to try to apply cosmetic. Further, conventionally, cosmetic for trial use has been usually contained in a small container and is distributed to a consumer, the quantity of the distributed cosmetic usually exceeds that needed for one time trial because of the volume of the container. Contrary to the conventional method, when the quantity of cosmetic for only one trial application is attached to the disposable applicator, waste of cosmetic is minimized compared with the conventional method.

When cosmetic for trial use is intended to be attached to the applicator, it is preferred that the cap 6 is made of a transparent material, such as plastics, since the color of the attached cosmetic can be observed from the outside. In addition, it is preferred that the color of the fibers at the core portion is transparent or white, since the color of the cosmetic can be easily recognized.

When rouge is attached to the applicator, it is preferred that the handle portion is so thermoformed that the applying portion becomes flat. When, eye shadow is attached to the applicator, it is preferred that the handle portion near the applying portion is so thermoformed that the applying portion becomes conical. It is preferred that the handle portion is covered by the sheet-like material 4 as illustrated in FIGS. 24 and 25, however, the sheet-like material may be omitted.

Prior to the explanation of a method and an apparatus for producing an applicator for makeup use of the present invention, an explanation will now be given with regard to a method for producing a rod-like material 10, which is a raw material of the applicator for makeup use of the present invention, referring to FIGS. 4 to 8.

Figure 5:
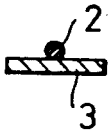
FIG. 5 is a cross sectional view taken along line 5—5 in FIG. 4.

As it is illustrated in FIGS. 4 and 5, a tow-like bundle of crimped thermoplastic fibers 3 is opened by a tow treating apparatus of a conventionally known type. A plurality of straight filaments 2 are gathered together and are fed to the opened tow like bundle of crimped thermoplastic fibers 3.

Before or after the straight filaments 2 are fed, solvent or plasticizer which has been explained with the first embodiment is applied to both the upper and lower sides of the opened tow-like bundle of thermoplastic fibers 3 by means of a spray gun or a coating roller.

Thereafter, the tow-like bundle of thermoplastic fibers 3 in a opened condition and the straight filaments 2 are guided by means of a guide 11 so that the bundle of thermoplastic fibers 3 wraps around the straight filaments 2 and that the bundle of thermoplastic fibers 3 are gathered.

Figure 6:
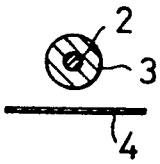
FIG. 6 is a cross sectional view taken along line 6—6 in FIG. 4.
Figure 7:
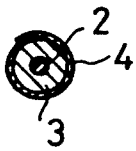
FIG. 7 is a cross sectional view taken along line 7—7 in FIG. 4.

A sheet-like material 4 is withdrawn from a roll 14, on which the sheet-like material such as paper or film is wound, and is fed to the gathered bundle of thermoplastic fibers 3 (see FIG. 6).

Then, the guide 12 guides the sheet-like material 4 so that the sheet-like material 4 covers the outer periphery of the bundle of thermoplastic fibers 3. In this case, adhesive may be applied to a longitudinal edge of the sheet-like material 4, and the longitudinal edges of the sheet-like material 4 may be overlapped with each other and may be adhered to each other (see FIG. 7).

A continuous rod-like material which has passed through the guide 12 is cut in a predetermined length by a cutting device 13. When the cut rod-like material is allowed to cool or is cooled, partial adhesion of the fibers occurs on points of the bundle crimped thermoplastic fibers 3 and the shape of the bundle of crimped thermoplastic fibers 3 is fixed. As described above, rod-like material 10 which is illustrated in FIG. 8 and which is a raw material of the applicator 1 for makeup use of the present invention is obtained.

A method and apparatus for manufacturing the applicator for makeup use of the present invention will now be explained with reference to an embodiment illustrated in FIGS. 1 to 3.

Figure 8:
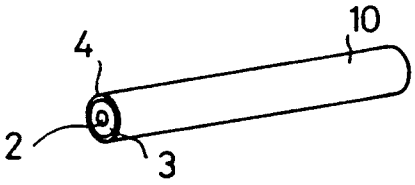
FIG. 8 is a perspective view of the product manufactured by the manufacturing step illustrated in FIG. 4.

The sheet-like material 4 is omitted from the rod-like material 10 which is illustrated in FIG. 8 and which is a raw material of the applicator 1 for makeup use, and thus, rod-like bundle of fibers as illustrated in FIG. 1(*a*) is prepared. A cutting device 20 is applied to the bundle of fibers at a position a predetermined distance from an end of the bundle.

The cutting device illustrated in FIG. 2 has a straight part 21 and a circular part 22 on the knife edge similar to a nipper which is used to strip off covering of an electric.

As illustrated in FIGS. 1(*b*) and 2(*b*), the bundle of fibers are cut by engaging the knives 21 and 22 of the cutting device 20. Since the knife of the cutting device 20 is provided with the circular part 22, the fibers 2 of the core portion are not cut but only the crimped fibers 3 of the sheath portion are cut.

When the cutting device 20 is moved to the right as indicated by arrow A in FIG. 1(*b*), the fibers 3 of the sheath portion at the cut end is moved with the cutting device 20 and is removed, and then the fibers 2 of the core portion which will be the applying portion 1*a* becomes exposed as illustrated in FIG. 1(*c*).

Then, as illustrated in FIGS. 1(*d*) and 3, a part 1*b* of the fibers 3 of the sheath portion corresponding to the base of the applying portion 1*a* is thermoformed by a thermoforming device 25. The thermoforming device illustrated in FIG. 3 comprises two dies having tapered portions therein, and each die has a heater (not illustrated) mounted therein. The handle portion 1*b* corresponding to the base of the applying portion 1*a* is sandwiched by the dies, and the crimped thermoplastic fibers 3 of the sheath portion located at the handle portion 1*b* are pressed by the dies when the dies are closed in a vertical direction and are thermally set in a pressed condition by the heat from the thermoforming device.

The thermoforming temperature is so selected that the thermoplastic fibers 3 of the sheath portion are softened, i.e., a temperature between 200° C. and 230° C. for acetate fibers and a temperature between 190° C. and 240° C. for acrylic fibers. When thermoplastic fibers such as polyamide fibers are used as the fibers 2 of the core portion, it is preferred that the thermoforming temperature is set lower than the softening temperature of the fibers 2 of the core portion. Alternatively, it is preferred that the temperature of the portion in the thermoforming device 25, with which the fibers 2 of the core portion to be the applying portion 1*a* is contact when the bundle of the fibers are positioned on the thermoforming device 25, is so designed that it is lower than the thermoforming temperature.

When the bundle of the fibers is removed from the thermoforming device 25, the applicator 1 for makeup use of the present invention which is illustrated in FIGS. 1(*e*) to 1(*g*) is obtained.

Another embodiment of a method and an apparatus for manufacturing the applicator for makeup use of the present invention will now be explained with reference to the embodiment illustrated in FIGS. 11 to 26.

First, a number of rod-like materials 10, the construction of which has been described with reference to FIG. 4, are fed to a hopper 30. The rod-like materials 10 are fed one by one to the cutting device 31 from the bottom of the hopper 30 while they are similarly directed.

The cutting device 31 comprises: a pair of rotary wheels 32 for supporting the rod-like materials; a pressure roller 33 disposed between the wheels 32; two rotary knives 34 and 35 disposed coaxial with the pressure roller 33 on the extension of the axis of the pressure roller 33; and a guide plate 36 (see FIGS. 13 to 17).

Figure 14:
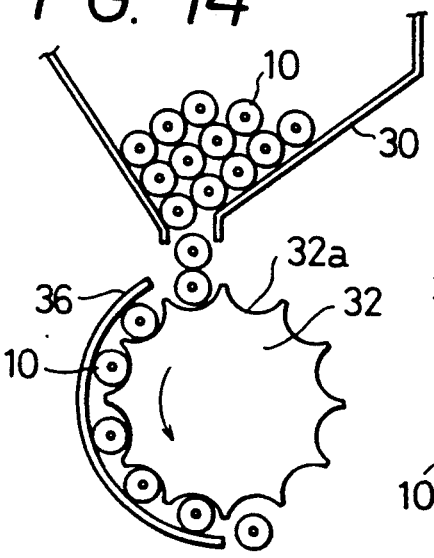
FIG. 14 is an end elevation along line 14—14 in FIG. 13.

The rod-like material supporting wheels 32 have number of recesses 32*a* for accommodating the rod-like materials 10 formed at the outer peripheries thereof as illustrated in FIG. 14.

Figure 15:
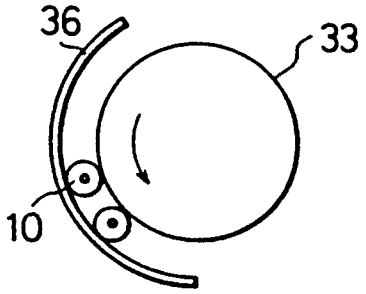
FIG. 15 is an end elevation along line 15—15 in FIG. 13.

As illustrated in FIG. 15, the pressure roller 33 serves to press the rod-like materials 10 against the guide plate 36, and the outer surface of the pressure roller 33 is so designed that its coefficient of friction is high. For example, a material which has a high coefficient of friction is used at the outer surface of the pressure roller 33, or special treatment by which coefficient of friction becomes high, such as knurling, is done on the outer surface. The pressure roller 33 rotates in a direction denoted by an arrow integrally with the rod-like material supporting wheels 32.

The guide plate 36 is a stationary disposed circular guide plate, and it prevents the rod-like materials 10 accommodated in the recesses 32*a* of the rod-like material supporting wheels 32 from being dropped, and at the same time, it cooperates with the pressure roller 33 so as to rotate the rod-like materials 10 on their axes. More specifically, while the rod-like materials 10 accommodated in the recesses 32*a* of the rod-like material supporting wheels 32 are moved along a circular path, i.e., a circular path formed between the guide plate 36 and the pressure roller 33, in accordance with the rotations of the rod-like material supporting wheels 32 and the pressure roller 33, the rod-like materials 10 are pressed to the guide plate 36 by the pressure roller 33, and as a result, the rod-like materials 10 move forwardly while they rotate in a direction opposite to the rotating direction of the pressure roller 33 (see FIG. 15).

Figure 13:
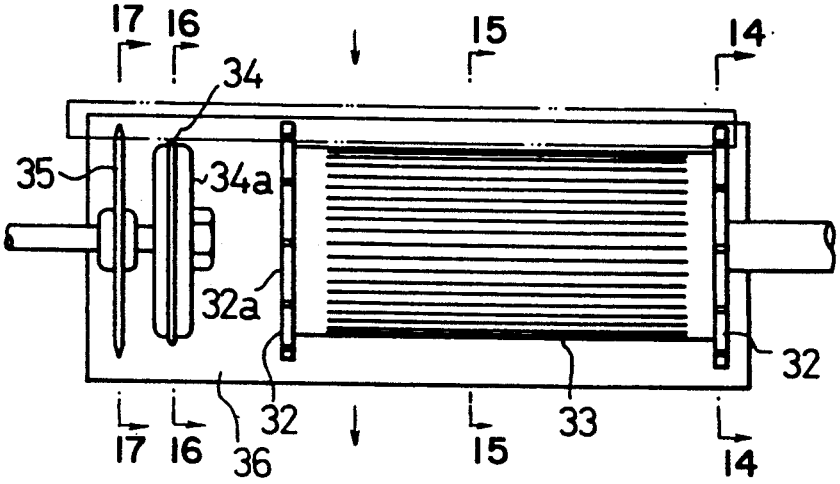
FIG. 13 is a side view of a cutting device for cutting rod-like material.
Figure 16:
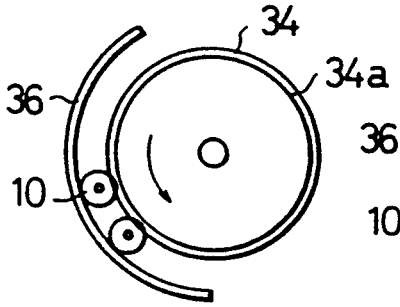
FIG. 16 is an end elevation along line 16—16 in FIG. 13.
Figure 17:
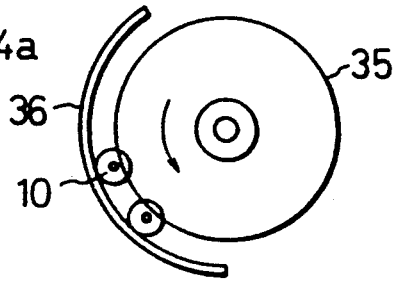
FIG. 17 is an end elevation along line 17—17 in FIG. 13.

As illustrated in FIGS. 13, 16 and 17, of the two rotary knives 34 and 35, the rotary knife 34 located near the rod-like material supporting wheels 32 serves to form a circumferential cut, i.e., the second cut, to the sheet-like material 4 of the rod-like material 10, and the other rotary knife 35 serves to form a circumferential cut, i.e., the first cut, to the sheet-like material 4 of the rod-like material 10 and the fibers 3 of the sheath portion except for the fibers 2 of the core portion. Accordingly, the outer diameter of the rotary knife 35 is larger than that of the rotary knife 34. When the rod-like materials 10 move along the circular path, they contact the two rotary knives 34 and 35, and at the same time the rod-like material 10 are rotated on their axes. Accordingly, two cuts are formed over the entire circumference of the rod-like material 10. It is preferred that a guide 34*a* for preventing excessive cutting is disposed on the rotary knife 34 (see FIG. 16). The rotary knife 35 may be also provided with a guide for preventing excessive cutting.

Although the rotary knives 34 and 35 may be rotated in synchronism with the rotations of the rod-like material supporting wheels 32 and the pressure roller 33, it is preferred that the rotary knives 34 and 35 are rotated at a speed higher than that of the rod-like material supporting wheels 32 and the pressure roller 33 in order to form cuts easily.

Since the cutting device 31 has a construction as described above, the rod-like materials 10 fed from the hopper 30 to the cutting device 31 are accommodated in the recesses 32*a* of the rod-like material supporting wheels 32, and they are transferred along the circular path while they are rotated on their axes, and they are dispatched downwardly. During transfer along the circular path, cuts are formed in the sheet-like materials 4 and the fibers 3 of the sheath portions of the rod-like materials 10.

Then, the rod-like materials 10 dispatched one by one from the cutting device 31 are loaded on a rod-like material conveying device 40 which is disposed below the cutting device 31. The conveying device 40 is provided with a pair of chains with attachments and a number of receivers 42 of the rod-like materials 10. In FIGS. 18 to 23, although the attachment is indicated by reference numeral 41, the chain portion is omitted.

Figure 18:
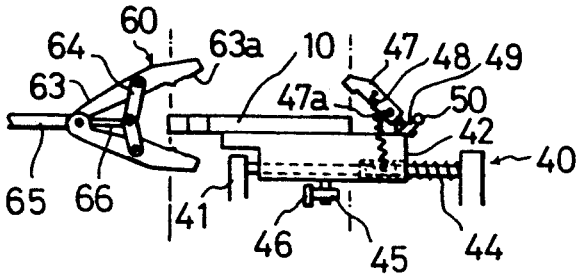

The rod-like material receiver 42 is slidably supported on a shaft 43, which extends over the attachment 41, and is urged in one direction, i.e., to the left in FIG. 18, by a spring 44. A stationary guide cam 46 is fixed to a machine frame and extends preferably along the entire chains with attachments and at least along a portion from position 18 to position 23 in FIG. 11. The rod-like material receiver 42 has a guide roller 45 rotatably supported on the bottom thereof which is so urged by the spring 44 that the guide roller 45 contacts with the guide cam 46. As a result, the rod-like material receiver 42 horizontally slides in accordance with the contour of the guide cam 46 as the chains with attachments move.

The rod-like material receiver 42 has a gripping member 47 which is mounted swingably about a pivot axis 47*a* and which is normally urged by a spring 48 in such a direction that it grips the rod-like material 10. A guide roller 49 is disposed at an end of the gripping member 47. The guide roller 49 engages with a guide 50 disposed around position 18 in FIG. 11 and a guide 51 disposed before position 23 in FIG. 11, and it swings the gripping member 47 from the gripping position (see FIGS. 19 to 22) to the releasing position (see FIG. 18 or 23) against the spring force of the spring 48.

An explanation will now be provided for the device 60 which serves to remove the fibers 3 of the sheath portion and the sheet-like material 4 beyond the cut.

This embodiment is integrally provided with the device for removing the fibers 3 of the sheath portion and the sheet-like material 4 beyond the first cut formed by the cutting device 31 and the device for removing the sheet-like material 4 beyond the second cut formed by the cutting device 31.

The removing device 60 comprises a conveyor 61, which moves at a speed almost same as the moving speed of the chains with attachment, and a plurality of sets of removing members 62, which are attached to the conveyor 61.

Figure 19:
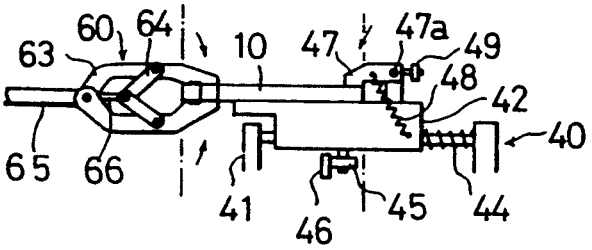
Figure 20:
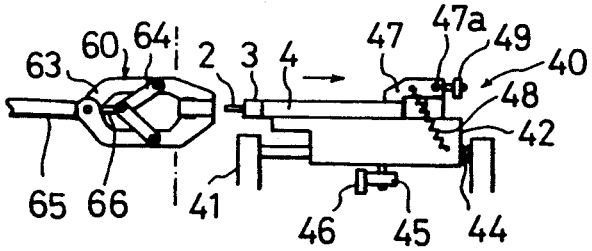

Referring to FIGS. 18 to 20, each set of removing member 62 is provided with a pair of grasping members 63, ends of which are pivoted to each other by a pin, and a pair of link members 64, which control the opening and closing of the grasping members 63.

The grasping members 63 are pivoted at an end of a hollow rod 65 and have at free ends thereof grasping surfaces 63*a* for holding the sheet-like material 4 and the fibers 3 of the sheath portion. The grasping surfaces 63*a* may be rugged in an appropriate shape in order to securely hold the sheet-like material 4 and the fibers 3 of the sheath portion.

A rod 66 is slidably inserted into the hollow rod 65. An end of the rod 66 is pivoted to ends of the pair of link members 64, and the other ends of of the link members 64 are pivoted to central portions of the grasping members 63, respectively.

When the rod 66, which operates the opening and closing of the link members 64, slides horizontally, the grasping members 63 operates between the open condition illustrated in FIG. 18 and the closed condition illustrated in FIG. 19. The sliding movement of the rod 66 is performed by a suitable member, for example, by an appropriate cam fixed to the machine frame, by which the grasping members open and close in accordance with the movement of the conveyor 61.

The removing device 60 cooperates with the rod-like material conveying device 40 which has been described previously so as to remove the fibers 3 of the sheath portion and the sheet-like material 4 located at the end of the rod-like material 10. More specifically, first, as illustrated in FIG. 18, at position 18 in FIG. 11 below the cutting device 31, a rod-like material 10 dispatched from the cutting device 31 rides on a receiver 42 of the rod-like material conveying device 40. In this case, the gripping member 47 of the rod-like material conveying device 40 is located in a releasing position where the gripping member 47 is lifted by the guide 50, and the grasping members 63 of the removing device 60 are also open.

Figure 11:
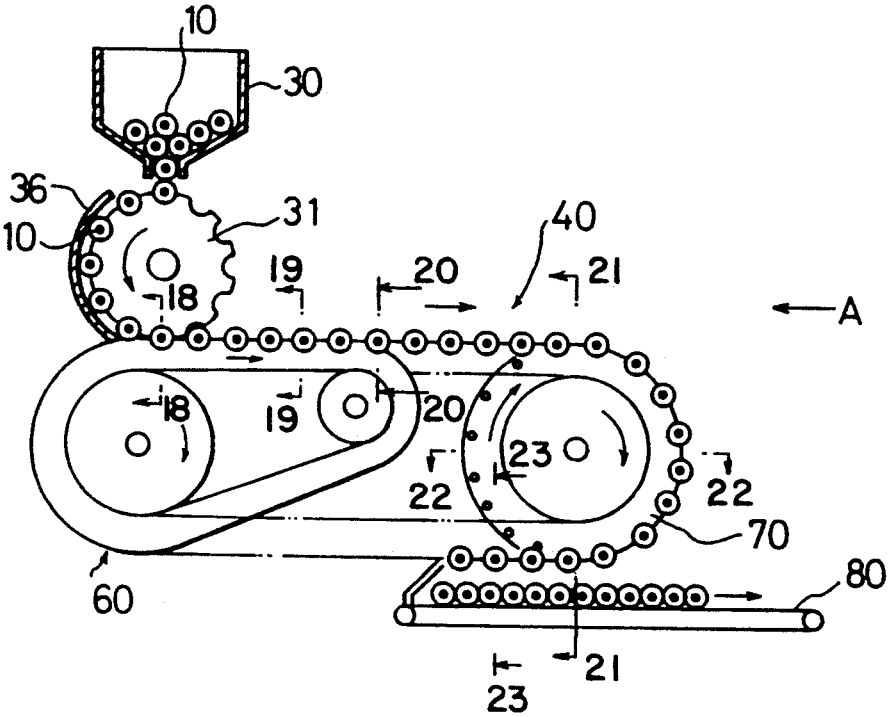
FIG. 11 is a schematic front view of a manufacturing apparatus for effecting the manufacturing method of the present invention.
Figure 12:
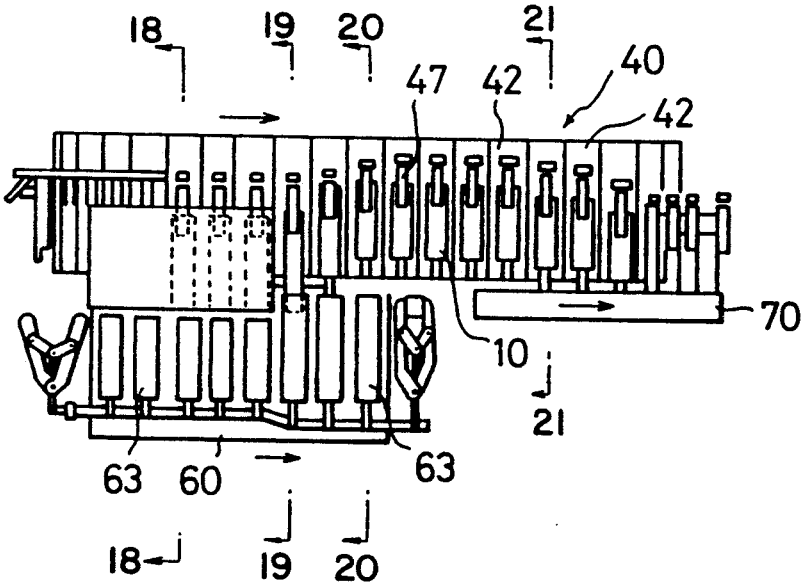
FIG. 12 is a schematic plan view of FIG. 11.

When the receiver 42 and the grasping members 63 reach position 19 after they move to the right in FIGS. 11 and 12 from the position 18, the grasping members 63 are closed as illustrated in FIG. 19 so at to securely hold the end of the rod-like material 10 where the cuts are formed. At the position 19, the engagement between the guide roller 49 and the guide 50 are disengaged, and the gripping member 47 similarly holds the other end of the rod-like material 10. In this case, the receiver 42 is moved to the left in FIG. 19 by means of the spring 44 and locates the advanced position where the receiver nears the grasping members 63.

When the receiver 42 and the grasping members 63 reach position 20 after they move to the right in FIGS. 11 and 12 from the position 19, the conditions illustrated in FIG. 20 appear. More specifically, the receiver 42 is moved to the right from the advanced position illustrated in FIG. 19 to a retracted position illustrated in FIG. 20 where the receiver is away from the grasping members 63. During this movement, the gripping member 47 continues to hold the end of the rod-like material 10, and the grasping members 63 also remain closed. Accordingly, the fibers 3 of the sheath portion and the sheet-like material 4 located beyond the cut at the end of the rod-like material 10 are continued to be securely held, while the rod-like material 10 itself is moved to the retracted position together with the receiver 42. Thus, the fibers 3 of the sheath portion and the sheet-like material 4 beyond the cut are separated from the rod-like material 10. As a result, as illustrated in FIG. 20, at the end of the rod-like material 10, the fibers 2 of the core portion become exposed and the fibers 3 of the sheath portion become exposed removal of the sheet-like material 4.

The rod-like material 10, wherein the fibers 2 of the core portion and the fibers 3 of the sheath portion are exposed, is conveyed to a thermoforming device 70 while it is held by the gripping member 47.

Figure 21:
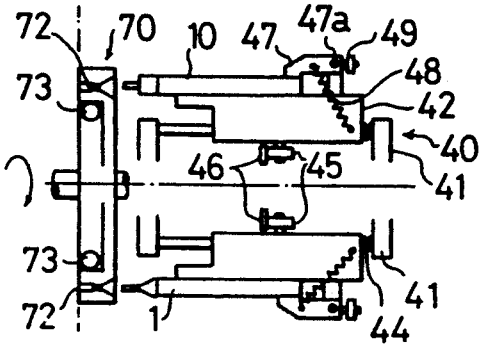
Figure 22:
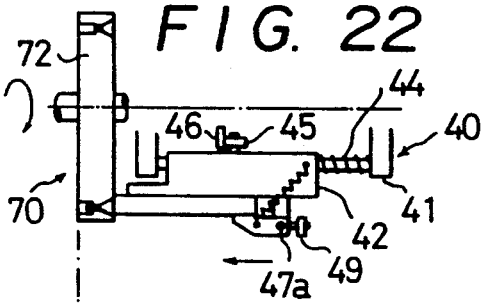

As illustrated in FIGS. 21 and 22, the thermoforming device 70 comprises a rotary disc 71, which has a plurality of holes 72 equidistantly formed on the disc surface thereof, and a heater 73, which is disposed integrally with the rotary disc 71 and which heats the rotary disc 71.

The distance between the holes 72 formed on the rotary disc 71 is so designed that it is equal to that between the gripping members 47 of the rod-like material conveying device 40, and the rotary disc 71 is rotated at a speed equal to the moving speed of the rod-like material conveying device 40.

The holes 72 serve to thermoform the exposed fibers 3 of the sheath portion in a desired shape, and the shape of the holes 72 is not limited as long as it can thermoform the exposed fibers 3 of the sheath portion. For example, the hole 72 comprises a tapered portion and a cylindrical portion, which is connected to the tapered portion and into which the fibers 2 of the core portion are inserted when the fibers 3 of the sheath portion are thermoformed.

The thermoforming device 70 cooperates with the rod-like material conveying device 40 and thermoforms the fibers 3 of the sheath portion located at the rod-like material 10 in a manner set forth below.

When the rod-like material 10, which is held by the gripping member 47 of the rod-like material conveying device 40, is moved to position 21 illustrated in FIGS. 11 and 12, the rod-like material 10 and one of the holes 72 of the thermoforming device align with each other (see the upper rod-like material 10 in FIG. 21). In this case, the receiver 42 is still located at the retracted position where the receiver 42 is moved to the right.

When the rod-like material conveying device 40 is further moved in a clockwise direction in FIG. 11, the receiver 42 is again moved to the left as denoted by an arrow in FIG. 22 toward the advanced position by means of the cooperation of the spring 44 and the guide 46, which guide is deflected toward the thermoforming device 70. As illustrated in FIG. 22, the front end, i.e., the end where the fibers 2 of the core portion are exposed, of the rod-like material 10 is inserted into the hole 72 of the rotary heating disc 71 at position 22 illustrated in FIG. 11, and the fibers 3 of the sheath portion are thermoformed.

The gripping member 47 is further advanced while the front end of the rod-like material 10 is inserted into the hole 72, and when the gripping member 47 is advance to a position opposite to position 21 in FIG. 11, i.e., the positions are symmetric with respect to the rotational axis, the receiver 42 is again guided by the guide 46 and is moved to the retracted position so that the front end of the rod-like material 10 is taken out from the hole 72 of the rotary heating disc 71 (see the lower rod-like material 10 in FIG. 21). The fibers 3 of the sheath portion located at the front end of the rod-like material 10 are thermoformed in a conical shape, and the applicator 1 for makeup use of the present invention is obtained.

Figure 23:
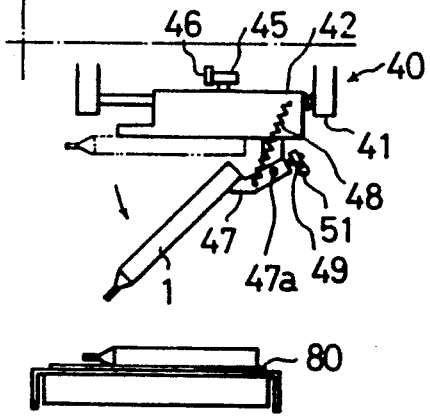
FIG. 23 is an end elevation at position 23 in FIG. 11 of the device for transferring the rod-like material.

When the rod-like material conveying device 40 is further moved until it arrives at position 23 in FIG. 11, the guide roller 49 mounted on the gripping member 47 abuts with the guide 51 as illustrated in FIG. 23 and opens the gripping member 47 against the force of the spring 48. Thus, the applicator 1 for makeup use is released from the gripping member 47.

The applicator 1 for makeup use drops and may be contained in a container disposed below the gripping member 47 or may be transferred to a predetermined station by means of a suitable conveyor 80.

Figure 26:
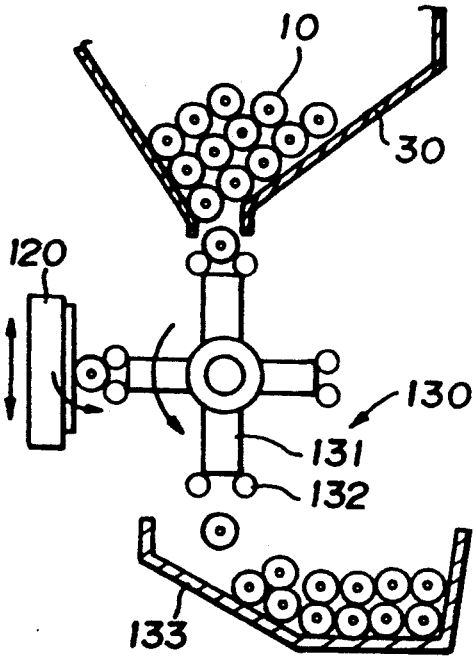
FIG. 26 is an elevation of another embodiment of a cutting device for forming slits to a rod-like material according to the present invention and a mechanism for transferring the rod-like material.
Figure 27:
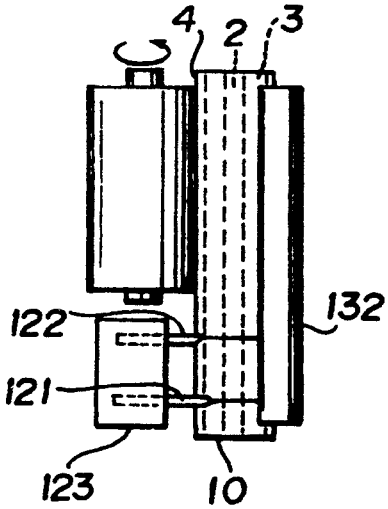
FIG. 27 is a plan view of the cutting device for forming slits to a rod-like material illustrated in FIG. 26.

FIG. 26 is an elevation of another embodiment of a cutting device for forming slits in the rod-like material according to the present invention and a mechanism for transferring the rod-like material, and FIG. 27 is a plan view of the cutting device for forming slits in the rod-like material illustrated in FIG. 26.

In this embodiment, the rod-like materials 10 are fed to the transferring mechanism 130 one by one from the exit formed at the bottom of the hopper 30 while they are lined up.

The transferring mechanism 130 of the illustrated embodiment is provided with four arms 131 radially extending and is intermittently turned by 90°. Each arm 131 has a pair of rollers 132 rotatably mounted at the end thereof. The number of the arms 131 and the intermittently turning angle are not limited to those described above and may be appropriately selected. The rod-like material 30 fed from the exit formed at the bottom of the hopper 30 enters between a pair of rollers 132 and is slightly held by the rollers 132. A cutting device 120 is disposed at a position which faces the end of the arm 131 when it turns by 90°.

The cutting device 120 is provided with a cutter holder 123 two knives 121 and 122 held by the cutter holder 123, and a drive roller 124. The cutter holder 123 is connected to a suitable drive mechanism, such as a fluid pressure cylinder (not shown), and is vertically reciprocated in FIG. 26. The drive roller 124 is driven by a suitable mechanism, such as an electric motor, and contacts with the rod-like material 10 so as to turn it on its own axis.

While the knives 121 and 122 are reciprocated, the rod-like material 10 is turned by the drive roller 124, and slits are formed on the periphery of the rod-like material 10. One of the knives, knife 121, is used to form a circumferential slit, i.e., the first slit, in the sheet-like material 4 and crimped fibers 3 at the sheath portion of the rod-like material 10, stopping short of the fibers 2 at the core portion. The other knife, 122, of the knives is used to form a circumferential slit, i.e., a second slit, in the sheet-like material 4 of the rod-like material 10.

After the slits are formed, when the arm further turns by 90°, the arm 131 arrives at a position where it is almost vertical, and the rod-like material 10 slightly held by the pair of rollers 132 disposed at the end of the arm 131 drops into a hopper 133 disposed beneath the arm 131 by its own gravity.

Figure 28:
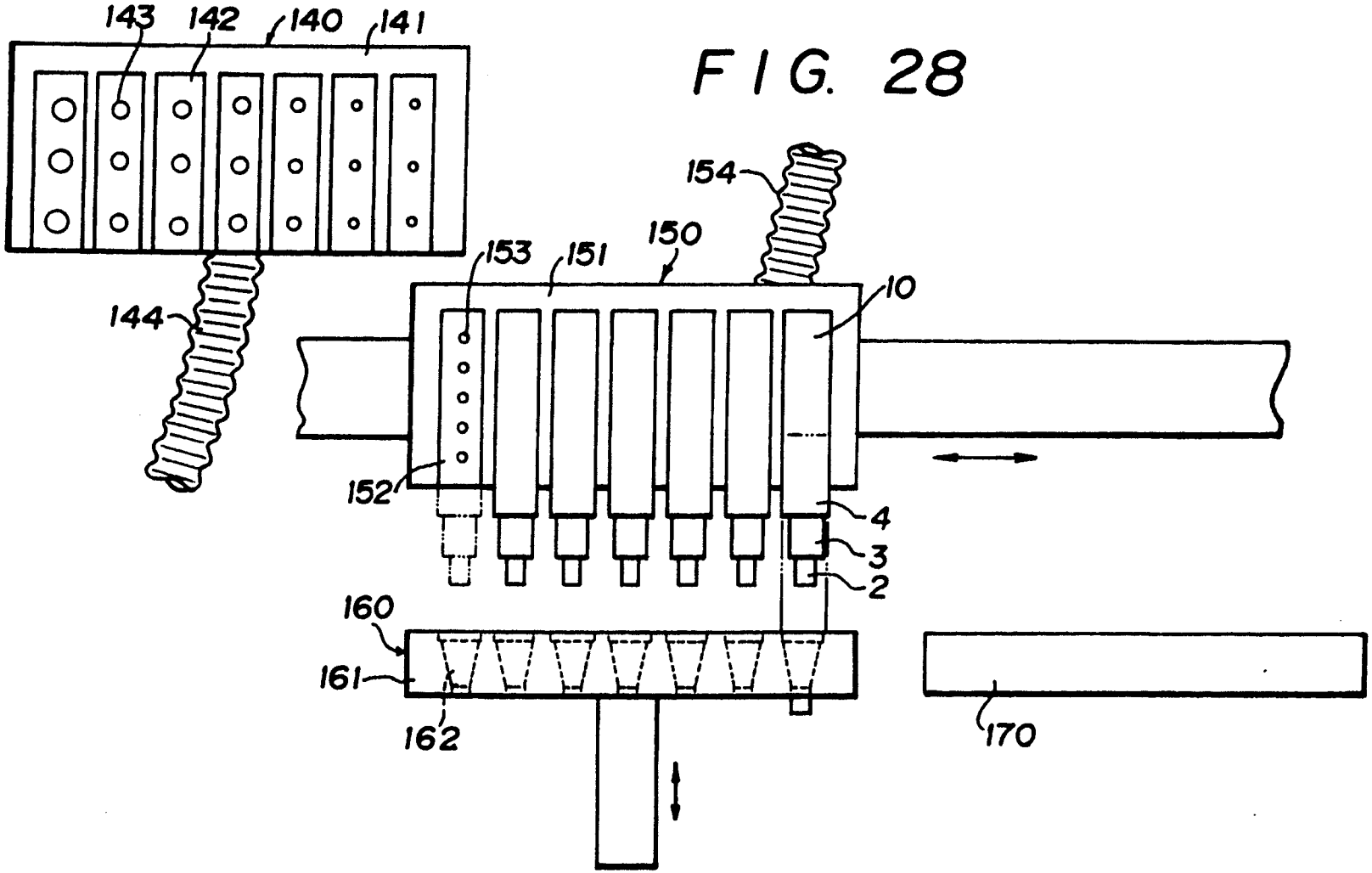
FIG. 28 is a plan view of still another embodiment of a mechanism for transferring and thermoforming a rod-like-material.

FIG. 28 is a plan view of a still another embodiment of a mechanism for transferring and thermoforming a rod-like material.

The rod-like material transferring device 140 is provided with a rod-like material receiving member 141 for receiving a plurality of rod-like materials 10. The rod-like material receiving member 141 has a plurality of recesses 142 for receiving the rod-like materials 10 formed thereon. The recess 142 has apertures 143 formed at the bottom thereof, which apertures are communicated with a flexible pipe 144, which is in turn connected to a vacuum source. Accordingly, while the vacuum source is operated, the rod-like member transferring device 140 is manually or mechanically advanced to a position where a number of rod-like materials 10 are disposed, for example, a hopper, the rod-like materials 10 are sucked and are aligned to the recesses 142 formed on the receiving member 141. Under this condition, the receiving member 141 is manually or mechanically moved to the thermoforming device 160 by extending the flexible pipe 144.

Another rod-like material transferring device 150 is so disposed that it faces the thermoforming device 160. The construction of the rod-like material transferring device 150 is similar to that of the foregoing rod-like material transferring device 140 and a rod-like material receiving member 151 has a plurality of recesses 152 for receiving the rod-like materials 10 formed thereon at a distance which is the same as that between the recesses 142 of the rod-like material transferring device 140. The recess 152 has apertures 153 formed at the bottom thereof, which apertures are communicated with a vacuum source via a flexible pipe 154. While the vacuum source of the transferring device 150 is operated, the rod-like materials 10 sucked to the above-described rod-like material transferring device 140 is neared to the rod-like member transferring device 150. Then, while the rod-like materials 10 are exposed to the suction by the rod-like material transferring device 150, the rod-like material transferring device 140 is slightly moved so that air enters through the apertures 143 formed at the recesses 142. As a result, the rod-like materials 10 are easily transferred to the rod-like material transferring device 150.

The thermoforming device 160 comprises a heater plate 161 and a drive mechanism, such as a hydraulic mechanism (not shown), for reciprocating the heater plate 161, and it can simultaneously thermoform a plurality of rod-like materials 10. More specifically, a plurality of holes 162 are formed corresponding to the recesses 152 of the rod-like material transferring device 150. The hole 162 comprises, for example, a tapered portion and a cylindrical portion connected to the tapered portion, into which cylindrical portion the fibers 2 of the core portion are inserted when the fibers 3 of the sheath portion are thermoformed. The thermoforming device 160 approaches the rod-like materials 10 sucked in the recesses 152 of the rod-like material transferring device 150 and thermoforms the fibers 3 of the sheath portion at the ends of the rod-like materials 10 while it accommodates the ends of the rod-like materials 10 within the holes 162.

Further, when the fibers of the core portion are formed flat as it is common for an applicator for rouge, it is preferred that a press device 170 is disposed in parallel with the thermoforming device 160 and that the rod-like materials 10 which have been thermoformed are subjected to a pressing operation. In this case, the rod-like materials 10 are transferred to the pressing station by laterally moving the rod-like material transferring device 150 just after they are heated in the thermoforming device 160. If this method is applied, since heat remains in the rod-like materials 10, it may be unnecessary to heat the die in the press device 170. The press device 170 can simultaneously thermoform a plurality of rod-like materials 10 sucked in the recesses 152 of the rod-like material transferring device 150.

According to the present invention, the cost of raw material of the applicator for makeup use is very inexpensive, since the applicator comprises a bundle of fibers, and since the number of fibers may be small because crimped fibers are used as the fibers of the sheath portion.

In the applicator for makeup use of the present invention, the fibers of the sheath portion, which comprises crimped fibers and which surround straight fibers of the core portion, are thermoformed at the base of the applying portion while they are not ground or abraded and while their amount is maintained. Accordingly, the thermoformed fibers of the sheath portion can securely hold the fibers of the applying portion, i.e., the fibers of the core portion. Since the applying portion is securely held and since accordingly the base of the applying portion is not bent easily, lines can be drawn at will by makeup cosmetics and the desired amount of makeup cosmetics can be applied to the desired portion.

In addition, according to the present invention, the applicator for makeup use of the present invention can have a suitable shape for a lip brush since the straight fibers of the applying portion can be arranged flat by thermoforming the base of the applying portion of the applicator of the present invention in a flat shape.

According to the present invention, the applicator can be used for trial use of cosmetic when the cosmetic has been previously attached to the fibers of the core portion of the applying portion, and the applicator is very convenient to use.

Besides, according to the method and apparatus for manufacturing the applicator for makeup use of the present invention, the fibers of the sheath portion are removed at an end of the rod-like bundle of fibers for a predetermined length while the fibers of the core portion are retained so that the fibers of the core portion are exposed, and the fibers of the sheath portion around the base portion of the exposed fibers of the core portion are thermoformed. Since an abrading or grinding operation is unnecessary in the method of the present invention, manufacture of the applicator for makeup use of the present invention does not take time, and the time required for manufacturing a single applicator is short. Accordingly, according to the method and apparatus of the present invention, the applicators can be manufactured at high productivity.

What is claimed is:

1. A method for producing an applicator for makeup use comprising:

preparing an elongated bundle of fibers of a predetermined length having a core portion consisting of a plurality of straight fibers and a sheath portion wrapped around said core portion consisting of crimped thermoplastic fibers adhering partially to each other;

removing a longitudinal section of said fibers of said sheath portion at one end of said bundle from about said fibers of said core portion to expose an end portion of said fibers of said core portion;

applying heat and pressure to said thermoplastic fibers over a region adjacent said exposed end portion of said core portion to heat-soften, radially compact, and bond together the thermoplastic fibers in said region about said core fibers.

2. A method for producing an applicator for makeup use comprising:

preparing an elongated element comprising:

a bundle of fibers of a predetermined length having a core portion formed from a plurality of straight fibers and a sheath portion wrapped about said core portion and formed from crimped thermoplastic fibers partially adhered to each other; and a sheet of material wrapped around the outer periphery of said bundle of fibers;

removing said sheet of material and said fibers of said sheath portion at one end of said elongated element while said fibers of said core portion are retained so that one end of said core portion becomes exposed; and applying heat and pressure to said thermoplastic fibers over a region adjacent said exposed end portion of said core portion to heat-soften, radially compact, and bond together the thermoplastic fibers in said region about said core fibers.

3. A method for producing an applicator according to claim 2, wherein said sheet of material is removed from said region in which said thermoplastic fibers are compacted and bonded together.

4. A method for producing rod shaped material for an applicator for makeup use comprising:

feeding a plurality of straight filaments to a flattened bundle of crimped thermoplastic fibers;

applying solvent or plasticizer to said bundle of thermoplastic fibers;

feeding sheet material to said bundle of thermoplastic fibers;

guiding said straight filaments, said bundle of thermoplastic fibers and said sheet material by means of a guide so that said bundle of crimped thermoplastic fibers enwrap said straight filaments with said straight filaments radially centered and said sheet material wraps in turn around said wrapped bundle of thermoplastic fibers to form a continuous elongated body; and cutting said continuous body into predetermined lengths so as to form elongated elements of said predetermined length.

* * * * *